US011464273B2

(12) United States Patent
Smith, Sr.

(10) Patent No.: US 11,464,273 B2
(45) Date of Patent: Oct. 11, 2022

(54) HELMET FACEMASK WITH TRANSPARENT SHIELD

(71) Applicant: Maurice C. Smith, Sr., Westampton, NJ (US)

(72) Inventor: Maurice C. Smith, Sr., Westampton, NJ (US)

( * ) Notice: Subject to any disclaimer, the term of this patent is extended or adjusted under 35 U.S.C. 154(b) by 66 days.

(21) Appl. No.: 17/078,819

(22) Filed: Oct. 23, 2020

(65) Prior Publication Data

US 2021/0127777 A1 May 6, 2021

Related U.S. Application Data

(60) Provisional application No. 62/930,677, filed on Nov. 5, 2019.

(51) Int. Cl.
*A42B 3/20* (2006.01)

(52) U.S. Cl.
CPC ..... *A42B 3/20* (2013.01)

(58) Field of Classification Search
CPC .... A41D 13/05; A41D 13/11; A41D 13/1184; A41D 13/1218; A42B 3/04; A42B 3/20; A42B 3/22; A42B 3/225; A42B 3/28; A42B 3/283; A42B 3/326; A42B 1/0181
USPC ..... 2/425
See application file for complete search history.

(56) References Cited

U.S. PATENT DOCUMENTS

| | | | | |
|---|---|---|---|---|
| 4,999,856 | A * | 3/1991 | DuVall | A42B 3/20 2/9 |
| 5,095,552 | A * | 3/1992 | Parkinson | A42B 3/20 2/9 |
| 5,293,649 | A * | 3/1994 | Corpus | A42B 3/20 2/9 |
| 5,479,658 | A * | 1/1996 | Harris | A42B 3/20 2/9 |
| 5,555,567 | A * | 9/1996 | Corpus | A42B 3/20 2/9 |
| 6,102,033 | A * | 8/2000 | Baribeau | A42B 3/225 2/427 |
| 10,281,241 | B2 * | 5/2019 | Noordzij | A42B 3/22 |
| 2004/0199972 | A1 * | 10/2004 | Rickon | A42B 3/20 2/9 |
| 2006/0272067 | A1 * | 12/2006 | Gagnon | A41D 13/11 2/9 |
| 2016/0030779 | A1 * | 2/2016 | Twu | A62B 18/006 128/202.13 |
| 2021/0068489 | A1 * | 3/2021 | De Harde | A42B 3/20 |

* cited by examiner

*Primary Examiner* — Megan E Lynch
*Assistant Examiner* — Giao Quynh Thanh Hoang
(74) *Attorney, Agent, or Firm* — Ashok Tankha

(57) ABSTRACT

A facemask for a helmet has a lower facemask section with a plurality of guard bars extending across and down the facemask section. A plurality of frame members has internal slotting, each of the frame members being attached to more than one of the plurality of guard bars extending across and down the lower facemask section. A transparent shield is located within the internal slotting of each of the frame members and the shields are fixedly secured within the slotting. The shields provide protection from outside impact to the lower part of the face of a wearer.

3 Claims, 2 Drawing Sheets

HELMET FACEMASK WITH TRANSPARENT SHIELD

RELATED APPLICATION

This application claims the benefit of provisional application Ser. No. 62/930,677, filed on Nov. 5, 2019.

FIELD OF THE INVENTION

The present invention relates to the field of protective helmets, primarily for sporting events, including the game of football.

BACKGROUND OF THE INVENTION

Helmets comprising facemasks in football games and like high impact sports have been used for several decades. A facemask provides gated protection for the wear's face from opposing forces. However, current facemasks are fundamentally flawed since they are susceptible to tugging and twisting forces from the grip of an opponent, e.g. a tackler or blocker. These natural forces often result in severe neck, back and other major injuries.

In the past, facemasks having multiple bars forming a meshed grill have been designed to remedy the tugging of a facemask. However, the mesh on bars have been known to significantly lower the visibility of the wearer. The wearer may thus have issues tracking an object on the field. Other designs, such as break-away masks, were thought to avert the risks resulting from pulling of the helmet. In these designs, the facemask detaches when grasped. However, once the mask is torn off, the wearer is exposed to outside forces. Some helmets are also provided with upper transparent facemask shields, designed to protect the eyes of the wearer. However, the remainder of the face which the lower section of the facemask covers remains unprotected.

SUMMARY OF THE INVENTION

It is thus the object of the present invention to provide a helmet facemask which provides sufficient visibility, but, significantly prevents tugging and grasping of the facemask, particularly at its lower section, which is surrounded by lower bars of the facemask.

This and other objects are accomplished by the present invention, a facemask for a helmet having a lower facemask section with a plurality of guard bars extending across and down the facemask section. A plurality of frame members has internal slotting, each of the frame members being attached to more than one of the plurality of guard bars extending across and down the lower facemask section. A transparent shield is located within the internal slotting of each of the frame members and the shields are fixedly secured within the slotting. The shields provide protection from outside impact to the lower part of the face of a wearer.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
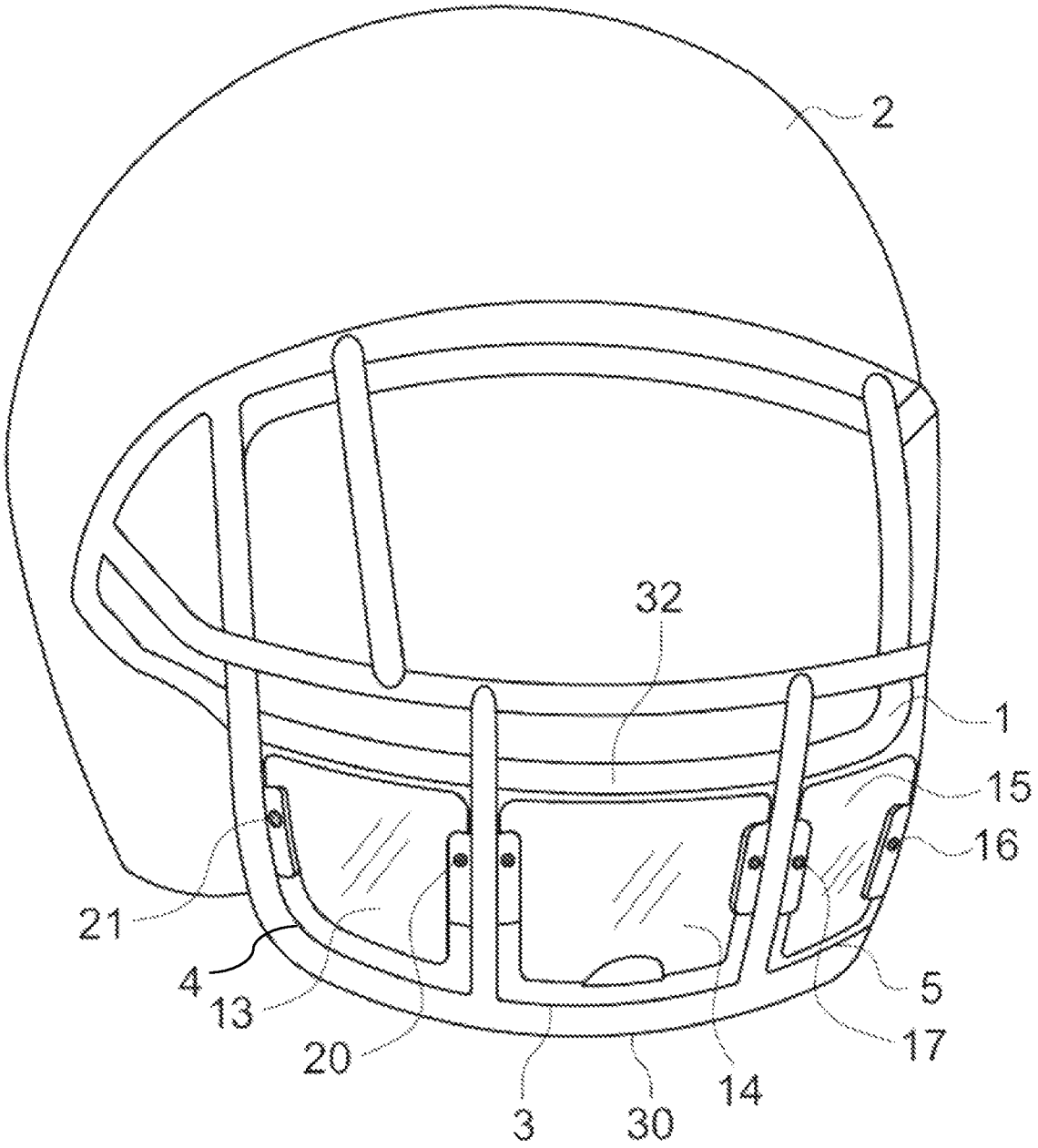
FIG. 1 is a perspective view of helmet with the facemask of the present invention.
Figure 2:
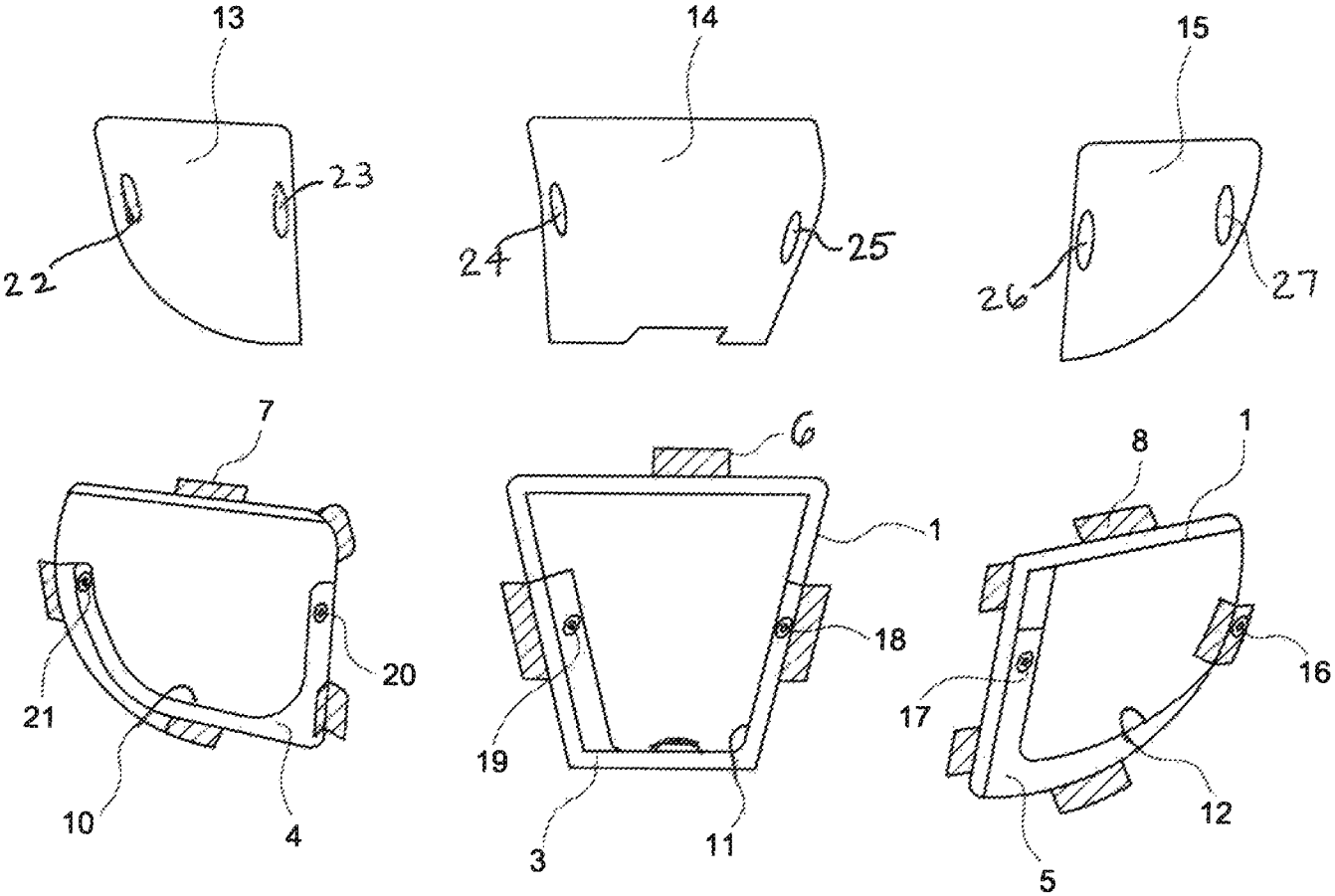
FIG. 2 is a view of the components of the facemask of the present invention.

The present invention comprises center frame member 3, right frame member 4, and left frame member 5, configured to be attached to facemask lower section 30 of helmet facemask 1 of helmet 2. Each frame member comprises upper clips 6, 7, and 8 which attach to mid-guard bar 32 of facemask 1, and a given number of lateral and bottom clips, e.g. in FIG. 2, two of these clips shown for frame member 3, and four clips are shown for frame members 4 and 5. These clips are configured to attach to the other guard bars of facemask lower section 30 which extend down and across the lower section. The frame member clips can be fixedly secured to the guard bars by any known means, such that each frame member is secured to more than one of the guard bars. For instance, frame member 3 is secured to mid-guard bar 32, and the guard bars which extend down from the mid-guard bar, adjacent to the frame member.

Frame members 3, 4, and 5 also have internal slotting 10, 11, and 12 into which transparent shields 13, 14, and 15 are inserted and retained. The slots provide a means for the insertion of the shields and for removal and replacement of damaged shields. Shields 13, 14, and 15 comprise holes 22-27 into which screws 16-21 are engaged in order to attach the shields in slots 10, 11, and 12.

In this manner, facemask 1 is provided with unique facemask protection by the addition of a plurality of transparent shields which cover the left, center, and middle of the lower facemask, thereby protecting a wearer of helmet 2 from outside impact forces.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A facemask for a helmet, said facemask comprising: a lower facemask section comprising a plurality of guard bars configured to extend across and down the lower facemask section; a plurality of frame members, wherein each of the frame members comprises an internal slot, and wherein each of the frame members is configured for attachment to the plurality of guard bars using a plurality of clips; a plurality of transparent shields, wherein each of the internal slots of the frame members is configured to receive one of the plurality of transparent shields; wherein each of the plurality of frame members is further configured to cover a bottom portion and two side portions of one of the plurality of transparent shields when one of the plurality of transparent shields is slideably inserted into the frame member; wherein each of the plurality of frame members is further configured with an opening at a top portion for allowing one of the plurality of transparent shields to be inserted into and removed out of the frame member; and a plurality of fasteners configured to fixedly secure one of the plurality of transparent shields within the internal slot of each frame member, after one of the plurality of transparent shields is inserted into the internal slot of the frame member.

2. The facemask as in claim 1, wherein the plurality of fasteners comprise screws.

3. The facemask as in claim 1, wherein the plurality of frame members comprise a center frame member, a left frame member, and a right frame member.

* * * * *